US007189949B1

(12) United States Patent
Bush et al.

(10) Patent No.: US 7,189,949 B1
(45) Date of Patent: Mar. 13, 2007

(54) POWER CONTROL SYSTEM AND METHOD FOR REGULATING POWER PROVIDED TO A HEATING DEVICE

(75) Inventors: Craig Palmer Bush, Lexington, KY (US); Steven Jeffrey Harris, Lexington, KY (US); Jeffrey Thomas Hines, Nicholasville, KY (US); Johnny Ray Sears, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/236,144

(22) Filed: Sep. 27, 2005

(51) Int. Cl.
*H05B 1/02* (2006.01)

(52) U.S. Cl. ..... 219/501; 219/216; 219/297; 399/69

(58) Field of Classification Search ..... 219/497, 219/501, 494, 506, 216; 399/69, 328, 335
See application file for complete search history.

(56) References Cited

U.S. PATENT DOCUMENTS

| | | | | |
|---|---|---|---|---|
| 3,851,144 | A * | 11/1974 | Hutner | 219/216 |
| 5,422,461 | A * | 6/1995 | Weiss et al. | 219/501 |
| 5,460,221 | A * | 10/1995 | Stalsberg et al. | 165/259 |
| 5,789,723 | A * | 8/1998 | Hirst | 219/501 |
| 6,111,230 | A * | 8/2000 | Cao et al. | 219/501 |

* cited by examiner

*Primary Examiner*—Mark Paschall
(74) *Attorney, Agent, or Firm*—Grossman, Tucker, Perreault & Pfleger, PLLC

(57) ABSTRACT

A circuit includes a switching device for controlling a power signal to be applied to a heating device. A control circuit is configured for comparing a temperature signal, indicative of the temperature of the heating device, to a temperature setpoint to generate a gate pulse signal that controls the duration of the power signal to be applied to the heating device. The control circuit is further configured for comparing the duration of the power signal to be applied to the heating device to a minimum pulse duration and, if the duration of the power signal to be applied to the heating device is at least equal to the minimum pulse duration, providing the gate pulse signal to the switching device.

25 Claims, 5 Drawing Sheets

POWER CONTROL SYSTEM AND METHOD FOR REGULATING POWER PROVIDED TO A HEATING DEVICE

TECHNICAL FIELD

This disclosure relates to control systems and, more particularly, to control systems that regulate the power provided to a heating device where the heating device may be used in a printer.

BACKGROUND

Printing devices often include heating devices that apply thermal energy to the media being processed by the printing device to e.g., affix toner to the media (i.e., for laser printers) or dry ink applied to the media (i.e., for inkjet printers). Typically, the temperature of these heating devices is regulated through the use of a controller circuit that e.g., monitors the temperature of the heating device and regulates the amount of power provided to the heating device. Typically, maintaining the proper temperature of the heating device is instrumental to the proper performance of the printing device.

SUMMARY OF THE DISCLOSURE

In one exemplary implementation, a circuit includes a switching device for controlling a power signal to be applied to a heating device. A control circuit may be configured for comparing a temperature signal, indicative of the temperature of the heating device, to a temperature setpoint to generate a gate pulse signal that controls the duration of the power signal to be applied to the heating device. The control circuit may be further configured for comparing the duration of the power signal to be applied to the heating device to a minimum pulse duration and, if the duration of the power signal to be applied to the heating device is at least equal to the minimum pulse duration, providing the gate pulse signal to the switching device.

One or more of the following features may also be included. A temperature monitoring device (e.g., a thermistor) may generate the temperature signal. The control circuit may be further configured for discarding the gate pulse signal if the duration of the power signal to be applied to the heating device is less than the minimum pulse duration. The switching device may include a triac and/or a silicon controlled rectifier. The power signal to be applied to the heating device may be an AC power signal and the switching device may be configured to provide the AC power signal to the heating device upon receiving the gate pulse signal and to continue to provide the AC power signal to the heating device until the AC power signal changes polarity.

In another exemplary implementation, an assembly includes a heating device. A switching device controls a power signal to be applied to the heating device. A control circuit may then be configured for comparing a temperature signal, indicative of the temperature of the heating device, to a temperature setpoint to generate a gate pulse signal that controls the duration of the power signal to be applied to the heating device. The control circuit may be further configured for comparing the duration of the power signal to be applied to the heating device to a minimum pulse duration and, if the duration of the power signal to be applied to the heating device is at least equal to the minimum pulse duration, providing the gate pulse signal to the switching device.

One or more of the following features may also be included. A temperature monitoring device may generate the temperature signal. The control circuit may be configured for discarding the gate pulse signal if the duration of the power signal to be applied to the heating device is less than the minimum pulse duration. The power signal to be applied to the heating device may be an AC power signal and the switching device may be configured to provide the AC power signal to the heating device upon receiving the gate pulse signal and to continue to provide the AC power signal to the heating device until the AC power signal changes polarity.

In another exemplary implementation, a method includes comparing a temperature signal, indicative of the temperature of a heating device, to a temperature setpoint to generate a gate pulse signal that controls the duration of a power signal to be applied to the heating device. The duration of the power signal to be applied to the heating device may be compared to a minimum pulse duration. The gate pulse signal is provided to a switching device if the duration of the power signal to be applied to the heating device is at least equal to the minimum pulse duration. The switching device may then be configured to control the power signal to be applied to the heating device.

One or more of the following features may also be included. The temperature signal may be generated using a temperature monitoring device (e.g., a thermistor). The gate pulse signal may be discarded if the duration of the power signal to be applied to the heating device is less than the minimum pulse duration. The switching device may include a triac and/or a silicon controlled rectifier. The power signal to be applied to the heating device may be an AC power signal and the switching device may be configured to provide the AC power signal to the heating device upon receiving the gate pulse signal and to continue to provide the AC power signal to the heating device until the AC power signal changes polarity.

In another exemplary implementation, a computer program product resides on a computer readable medium and has a plurality of instructions stored thereon. When executed by a processor, the instructions may cause the processor to compare a temperature signal, indicative of the temperature of a heating device, to a temperature setpoint to generate a gate pulse signal that controls the duration of a power signal to be applied to the heating device. The duration of the power signal to be applied to the heating device may be compared to a minimum pulse duration. The gate pulse signal is provided to a switching device if the duration of the power signal to be applied to the heating device is at least equal to the minimum pulse duration. The switching device is configured to control the power signal to be applied to the heating device.

One or more of the following features may also be included. The temperature signal may be generated using a temperature monitoring device (e.g., a thermistor). The gate pulse signal may be discarded if the duration of the power signal to be applied to the heating device is less than the minimum pulse duration. The switching device may include a triac and/or a silicon controlled rectifier. The power signal to be applied to the heating device may be an AC power signal and the switching device may be configured to provide the AC power signal to the heating device upon receiving the gate pulse signal and to continue to provide the AC power signal to the heating device until the AC power signal changes polarity.

The details of one or more implementations are set forth in the accompanying drawings and the description below.

Other features and advantages will become apparent from the description, the drawings, and the claims.

DETAILED DESCRIPTION

Figure 1:
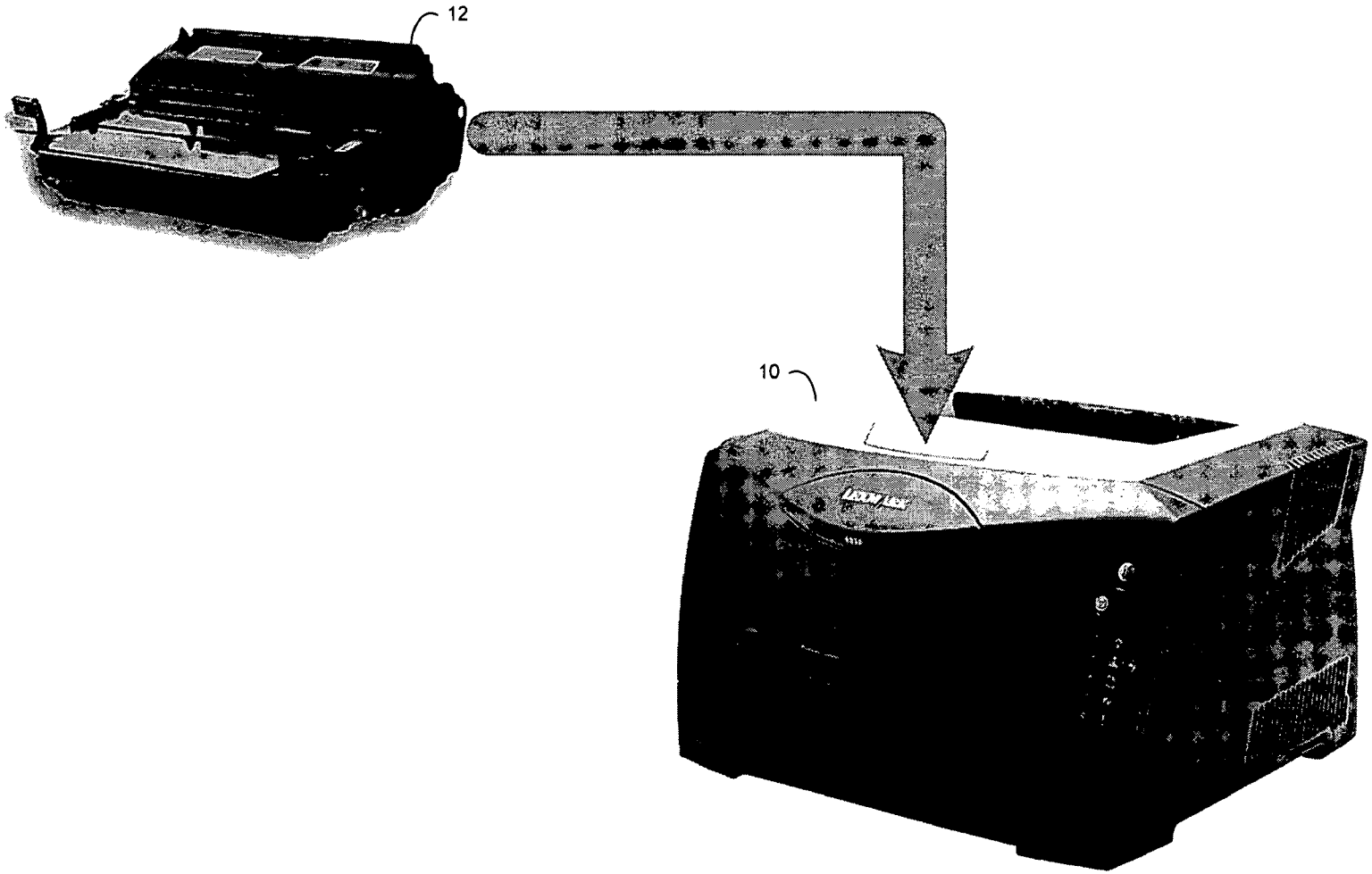
FIG. 1 is a diagrammatic view of an exemplary printing device and an exemplary printer cartridge for use within the printing device.

Referring to FIG. 1, there is shown an exemplary printing device 10 and an exemplary printer cartridge 12 for use within printing device 10. Printing device 10 may be coupled to a computing device (not shown) via e.g. a parallel printer cable (not shown), a universal serial bus cable (not shown), and/or a network cable (not shown). Printing devices herein may include electrophotographic printers, ink-jet printers, etc.

As is known in the art, printing device 10 is a device that accepts text and graphic information from a computing device and transfers the information to various forms of media (e.g., paper, cardstock, transparency sheets, etc.). Further and as is known in the art, a printer cartridge 12 is a component of printing device 10, which typically includes the consumables/wear components (e.g. toner and a drum assembly, for example) of printing device 10. Printer cartridge 12 typically also includes circuitry and electronics (not shown) required to e.g., charge the drum and control the operation of printer cartridge 12.

Figure 2:
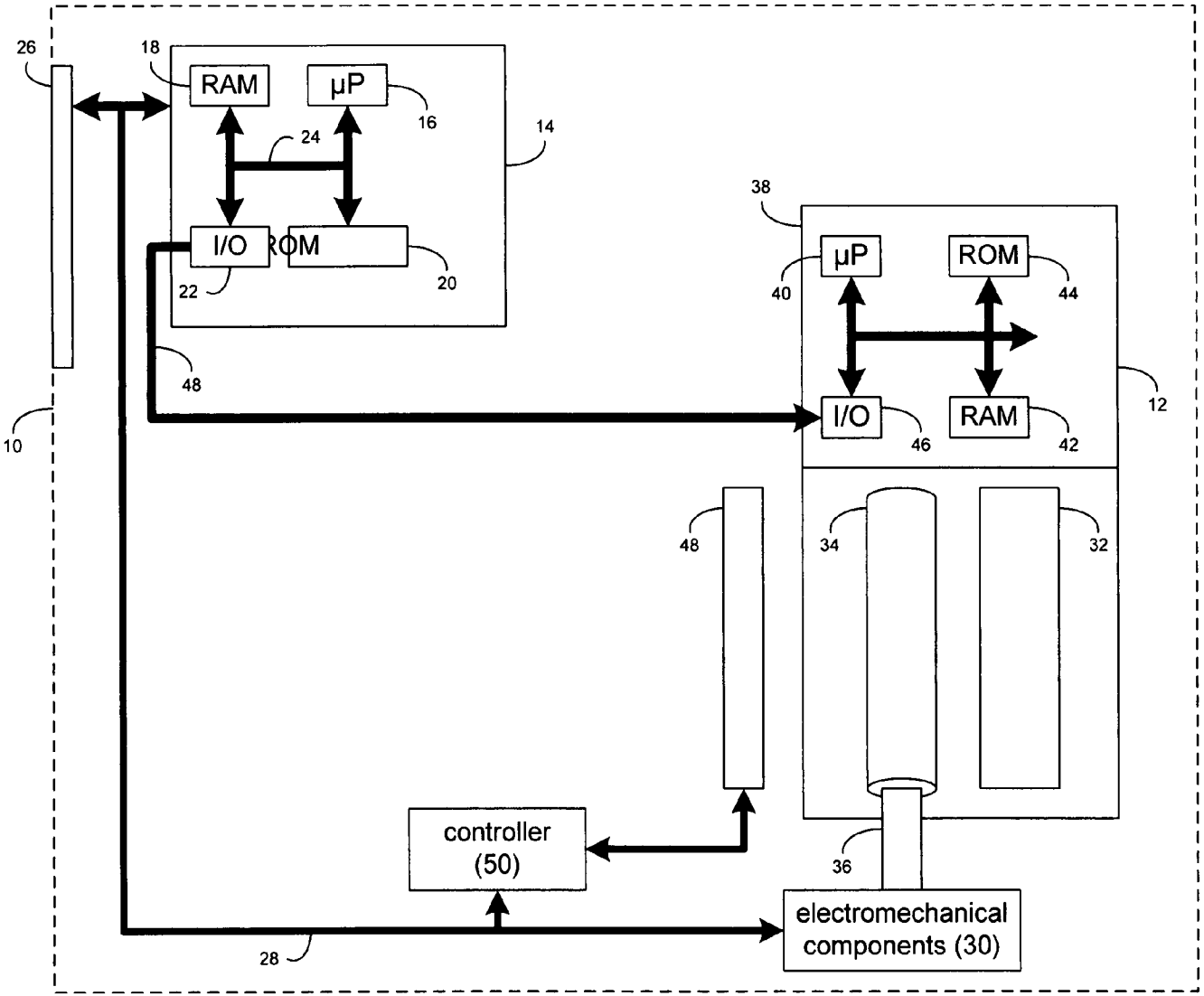
FIG. 2 is a diagrammatic view of the printing device of FIG. 1 interfaced to the printer cartridge of FIG. 1.

Referring also to FIG. 2, there is shown a diagrammatic view of an exemplary printer cartridge 12 interfaced with printing device 10. Typically, printing device 10 includes a system board 14 for controlling the operation of printing device 10. System board 14 may include a microprocessor 16, random access memory (i.e., RAM) 18, read only memory (i.e., ROM) 20, and an input/output (i.e., I/O) controller 22. Microprocessor 16, RAM 18, ROM 20, and I/O controller 22 may be coupled to each other via data bus 24. Examples of data bus 24 may include a PCI (i.e., Peripheral Component Interconnect) bus, an ISA (i.e., Industry Standard Architecture) bus, or a proprietary bus, for example.

Printing device 10 may include display panel 26 for providing information to a user (not shown). Display panel 26 may include e.g. an LCD (i.e. liquid crystal display) panel, one or more LEDs (i.e., light emitting diodes), and one or more switches. Display panel 26 may be coupled to I/O controller 22 of system board 14 via data bus 28. Examples of data bus 28 may include a PCI (i.e., Peripheral Component Interconnect) bus, an ISA (i.e., Industry Standard Architecture) bus, or a proprietary bus, for example. Printing device 10 may also include electromechanical components 30, such as: feed motors (not shown), gear drive assemblies (not shown), paper jam sensors (not shown), and paper feed guides (not shown), for example. Electromechanical components 30 may be coupled to system board 14 via data bus 28.

As discussed above, the exemplary printer cartridge 12 may include a reservoir for developing agent, such as a toner reservoir 32 and a toner drum assembly 34. The electromechanical components 30 may be mechanically coupled to printer cartridge 12 via a releasable gear assembly 36 that may allow the printer cartridge 12 to be removed from printing device 10. Developing agent may also include ink and any other materials or compounds suitable to create an image on, e.g., a sheet of media.

Exemplary printer cartridge 12 may include a system board 38 that controls the operation of printer cartridge 12. System board 38 may include microprocessor 40, RAM 42, ROM 44, and I/O controller 46, for example. The system board 38 may be releasably coupled to system board 14 via data bus 48, thus allowing for the removal of exemplary printer cartridge 12 from printing device 10. Examples of data bus 48 may include a PCI (i.e., Peripheral Component Interconnect) bus, an ISA (i.e., Industry Standard Architecture) bus, an I2C (i.e., Inter-IC) bus, an SPI (i.e., Serial Peripheral Interconnect) bus, or a proprietary bus.

The exemplary printing device 10 may include a heating device such as a fusing device 48 for affixing the toner (supplied by toner reservoir 32 and applied by toner drum assembly 34) to the media being processed by printing device 10. As will be discussed below in greater detail, the temperature of the exemplary fusing device 48 may be controlled by controller 50. Controller 50 may be coupled to system board 14 via data bus 28. Alternatively, controller 50 may be incorporated into system board 14.

Figure 3:
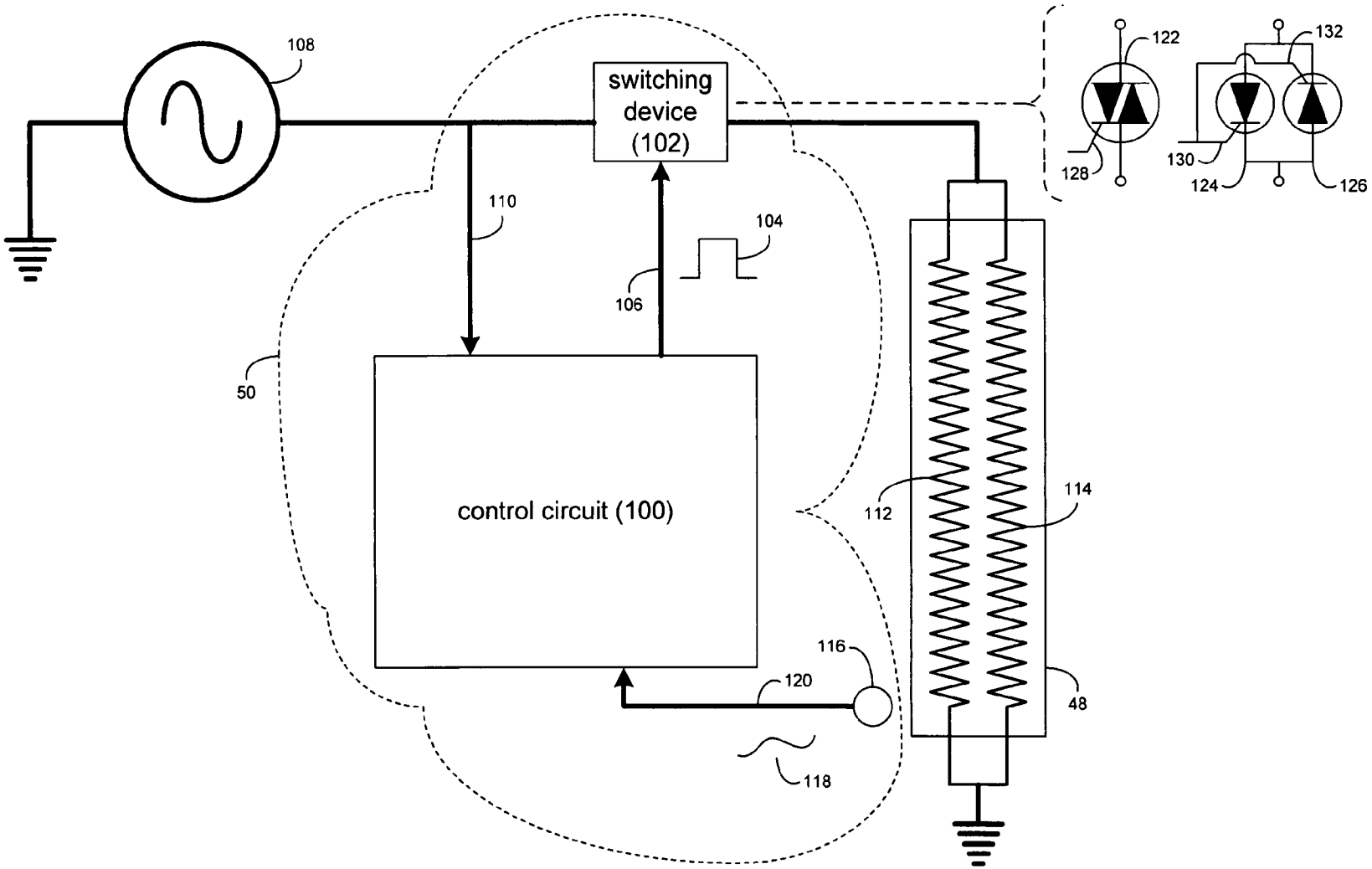
FIG. 3 is a diagrammatic view of the controller of FIG. 2.

Referring also to FIG. 3, there is shown an exemplary diagrammatic view of controller 50 interfaced with the exemplary fusing device 48. Controller 50 may include a control circuit 100 and a switching device 102. Control circuit 100 may be configured to provide a gate pulse signal 104 to switching device 102 via conductor 106. Switching device 102 may be configured to control the power signal 108 applied to fusing device 48. Control circuit 100 may further be configured to monitor power signal 108 via conductor 110. Control signal 108 may be a 120 volt, 60 Hertz AC (i.e., alternating current) signal. Control circuit 100 may further be configured to monitor the temperature of the exemplary fusing device 48 using a temperature monitoring device 116 (e.g., a thermistor), such that temperature monitoring device 116 provides a temperature signal 118 to control circuit 100 via conductor 120. Conductors 106, 110, 120 may be e.g., foil-based conductors on a printer circuit board and/or wired-based conductors, for example.

The exemplary fusing device 48 may include one or more discrete heating elements 112, 114 for converting electrical energy (from power signal 108) into thermal energy. Heating elements 112, 114 may be resistive heating elements (e.g., metallic or ceramic, for example). During operation, power signal 108 is applied to the exemplary fusing device 48 via switching device 102.

Temperature monitoring circuit 116 monitors the temperature of the exemplary fusing device 48 and generates temperature signal 118, which may be supplied to control circuit 100 via conductor 120. As discussed above, temperature monitoring circuit 116 may include a thermistor. As is known in the art, a thermistor is typically a solid-state, temperature-dependant resistance device. Accordingly, by monitoring the resistance of temperature monitoring device 116, the temperature of the exemplary fusing device 48 may be determined by control circuit 100.

The desired temperature of the heating device in the printer may be based one several variables, such as the operating mode of printing device 10 and the type of developing agent being used in printing device 10. In an exemplary and non-limiting case of toner, such may include particles of pigment in combination with polymers that may be applied to the media by toner drum assembly 34 (FIG. 2) and bonded to the media by the exemplary fusing device 48. Accordingly, the temperature of the exemplary fusing device 48 may be high enough to allow for the toner particles to melt and adhere to the media, yet not so high that it damages the media and/or other components of printing device 10. Further, the chemical composition of the developing agent (e.g. toner) may vary the temperature of the fusing device. Additionally, the operating mode of printing device 10 may vary the temperature of the heating (e.g. fusing) device. For instance, the exemplary fusing device 48 may be maintained at 100° C. during "Sleep Mode" (e.g., after printing device 10 is idle for ten minutes); device 48 may be maintained at 150° C. during "Standby Mode" (e.g., when printing device 10 is idle for less than ten minutes); and fusing device 48 may be maintained at 200° C. during "Use Mode" (i.e., when printing device 10 is bonding developing agent to media).

In the event that the temperature of the exemplary fusing device 48 (as monitored by temperature monitoring device 116 and determined by control circuit 100) is above the setpoint (e.g., 100° C., 150° C., or 200° C., for example) specified for the desired operating mode (e.g., "Sleep Mode", "Standby Mode", or "Use Mode", respectively), control circuit 100 may provide a gate pulse signal 104 to switching device 102 that prevents power signal 108 from being provided to fusing device 48. This, in turn, will result in a decrease in the temperature of fusing device 48.

Alternatively, if the temperature of the exemplary fusing device 48 is below the setpoint specified for the desired operating mode, control circuit 100 may provide a gate pulse signal 104 to switching device 102 that allows power signal 108 to be applied to fusing device 48. This, in turn, will result in an increase in the temperature of fusing device 48.

Switching device 102 may include a solid state switching device, such as triac 122. A triac is a three-terminal semiconductor for controlling current flow in either direction. A typical example of triac 122 is a Model No.: BTB24-600BWS triac manufactured by ST Microelectronics. Alternatively, a pair of SCRs (i.e., silicon controlled rectifiers) 124, 126 (arranged in a parallel head-to-toe configuration) may be utilized to achieve the same result as triac 122. When a gate voltage (e.g., gate pulse signal 104) is applied to gate 128 of triac 122 (or gate 130 of SCR 124 and gate 132 of SCR 126), triac 122 (or SCRs 124, 126) will conduct electricity, thus allowing power signal 108 to pass through switching device 102. Fusing device 48 will then be energized and the temperature sensed by temperature sensing device 116 will be elevated. Further once triac 122 or SCRs 124, 126 begins to conduct power signal 108, triac 122 or SCRs 124, 126 will continue to conduct until the current flowing through the triac or SCRs reaches zero.

Figure 4:
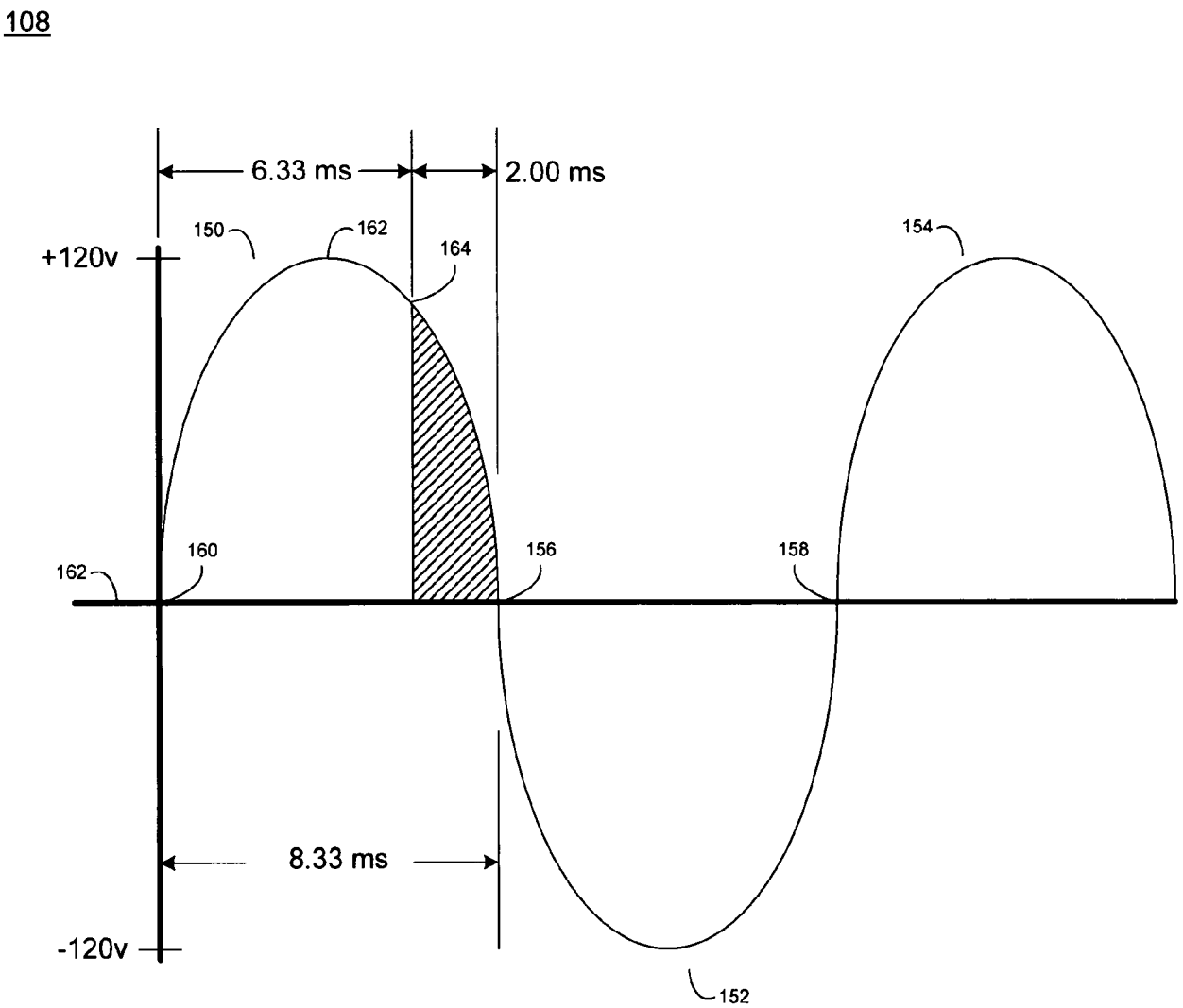
FIG. 4 is a diagrammatic view of a power signal to be applied to the fusing device of FIG. 2.

Referring also to FIG. 4 and as discussed above, power signal 108 may be a 120 volt, 60 Hertz AC signal. Accordingly, the voltage potential of power signal 108 may switch polarity after each half cycle. For example, power signal 108 may change from a positive polarity (during the first 180° portion 150 of the sinusoid) to a negative polarity (during the second 180° portion 152 of the sinusoid), and then back to a positive polarity (during the third 180° portion 154 of the sinusoid). Further, assuming that current tracks voltage (i.e., there is no lead or lag time between the voltage potential of power signal 108 and the current signal of power signal 108), whenever the voltage potential of power signal 108 is zero (e.g., at points 156, 158), the current flowing through switching device 102 is also zero. Accordingly and as discussed above, at this point, switching device 102 (due to triac 122 or SCRs 124, 126) may stop conducting and, therefore, power signal 108 may no longer be applied to fusing device 48. Fusing device 48 may then no longer be energized and the temperature sensed by temperature sensing device 116 may begin to decrease.

Since switching device 102 (due to triac 122 or SCRs 124, 126) may only stop conducting power signal 108 at the points at which the current flowing through switching device 102 is zero (e.g., at points 156, 158), in order to regulate the amount of power provided to fusing device 48, the point within the sinusoid at which gate pulse signal 104 is applied to switching device 102 may be varied. For example, in 60 Hertz power, a half cycle (e.g., portion 150) of the sinusoid is 8.33 milliseconds long. Accordingly, when applying full power to fusing device 48, switching device 102 may be immediately energized as soon as the voltage potential of power signal 108 is a non-zero value (e.g., at point 160). As discussed above, switching device 102 may then remain energized until point 156 (i.e., the point at which the current flowing through switching device 102 is zero). Accordingly, switching device 102 may be energized for 8.33 milliseconds of an 8.33 millisecond half cycle. Further, when applying half power to fusing device 48, switching device 102 may be energized at point 162 (i.e., midway through half cycle 150). Again, switching device 102 may remain energized until point 156 (i.e., the point at which the current flowing through switching device 102 is zero). Accordingly, switching device 102 may be energized for 4.16 milliseconds of an 8.33 millisecond half cycle.

When applying gate pulse signal 104 to switching device 102, gate pulse signal 104 may often need to be applied for a minimum pulse duration. As discussed above, switching device 102 may include one or more solid state devices (e.g., triac 122 and/or SCRs 124, 126). Further and as discussed above, once a gate pulse signal 104 is applied to switching device 102, the switching device 102 may remain energized (i.e., may conduct electricity and may allow power signal 108 to energize fusing device 48) until the current flowing through switching device 102 is reduced to zero. At this point, switching device 102 may be deenergized and, therefore, will no longer conduct electricity. Accordingly, power signal 108 may no longer energize fusing device 48. However, due to the solid state physics of switching device 102 (i.e., triac 122 and/or SCRs 124, 126), gate pulse signal 104 must be of sufficient duration to properly energize switching device 102. The minimum pulse duration of gate pulse signal 104 may vary depending on the specifics of switching device 102. For example, for a Model No.: BTB24-600BWS triac manufactured by ST Microelectronics, the minimum pulse duration of gate pulse signal 104 is approximately 1.00 milliseconds.

Figure 5:
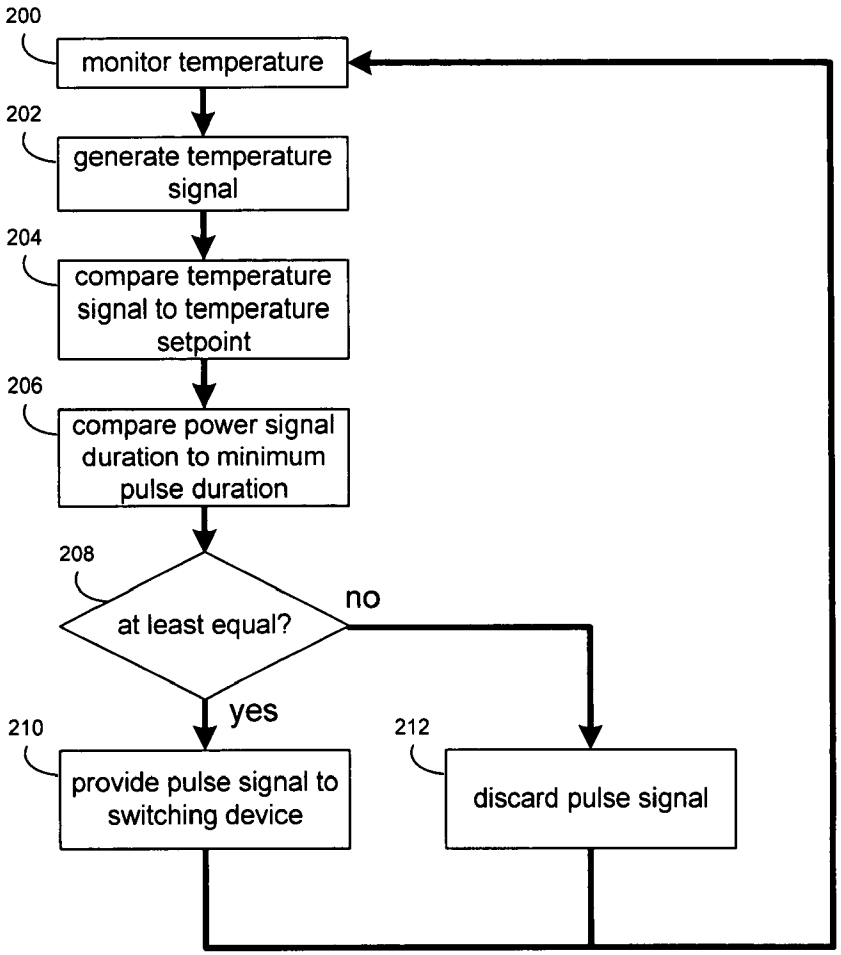
FIG. 5 is a flow chart of a process executed by the controller of FIG. 2.

Referring also to FIG. 5 and as discussed above, control circuit 100 may determine the temperature of fusing device 48 by monitoring 200 the resistance of temperature monitoring device 116 (e.g., a thermistor) and generating 202 temperature signal 118, which is provided to control circuit 100. For example, assume that fusing device 48 is in "Use Mode" (as discussed above) and, therefore, the desired setpoint is 200° C. Further, assume that temperature monitoring device 116 has a resistance of 1000 ohms at 200° C. Accordingly, temperature signal 118 provided to control circuit 100 should be indicative of a 1000 ohm resistive load (assuming that fusing device 48 is maintained at the 200° C. setpoint). Further, assume that temperature monitoring device 116 has a positive resistance/temperature coefficient and, therefore, as the temperature of fusing device 48 increases, the resistance of temperature monitoring device (as sensed by control circuit 100) also increases.

Continuing with the above-stated example, assume that control circuit 100 senses a resistance of 1020 ohms. Control circuit 100 may compare this monitored resistance value to a series of stored resistance values (e.g., in the form of a lookup table) to determine the actual temperature of fusing device 48, which in this scenario is 204° C. (see below). An example of such a lookup table may be as follows:

200° Celsius Setpoint (i.e., "Use Mode")

| Monitored Resistance | Monitored Temperature | Δ Resistance | Δ Temperature | Required Duration |
|---|---|---|---|---|
| 950 | 190° Celsius | −50 | −10 | 2.00 ms. |
| 960 | 192° Celsius | −40 | −8 | 1.60 ms. |
| 970 | 194° Celsius | −30 | −6 | 1.20 ms. |
| 980 | 196° Celsius | −20 | −4 | 0.80 ms. |
| 990 | 198° Celsius | −10 | −2 | 0.40 ms. |
| 1000 | 200° Celsius | 0 | 0 | 0.00 ms. |
| 1010 | 202° Celsius | 10 | 2 | 0.00 ms. |
| 1020 | 204° Celsius | 20 | 4 | 0.00 ms. |
| 1030 | 206° Celsius | 30 | 6 | 0.00 ms. |
| 1040 | 208° Celsius | 40 | 8 | 0.00 ms. |
| 1050 | 210° Celsius | 50 | 10 | 0.00 ms. |

As is shown in the above table, control circuit 100 may associate each "Monitored Resistance" (as sensed by temperature monitoring circuit 116) with a "Monitored Temperature". Typically, the relationship between monitored resistance and monitored temperature is defined by the manufacture of e.g., triac 122. Alternatively, this relationship may be determined empirically. From this relationship, a "Δ Resistance" column (which defines the deviation for desired resistance i.e., 1000 ohms) may be defined. Additionally, from this relationship, a "Δ Temperature" column (which defines the deviation for desired temperature i.e., 200° C.) may be defined. Control circuit 100 may then use one or more of these columns to define the entries in the "Required Duration" column. Specifically, the "Required Duration" column defines the amount of time that power signal 108 should energize fusing device 48 in order to achieve the desired setpoint. For example, if the desired setpoint of fusing device 48 is 200° C. and the "Monitored Temperature" of fusing device 48 is 198° C., control circuit 100 may compare 204 the monitored temperature signal to the temperature setpoint to determine that fusing device 48 should be energized for 0.40 milliseconds to raise the temperature of fusing device 48 to the 200° C. setpoint. Alternatively, if the "Monitored Temperature" of fusing device 48 is 192° C., as the fusing device is colder, fusing device 48 may need to be energized for a longer duration (i.e., 1.60 milliseconds) to raise the temperature of fusing device 48 to the 200° C. setpoint. Further, if the "Monitored Temperature" of fusing device 48 is greater than or equal to 200° C. (i.e., at or above setpoint), fusing device 48 will typically not be energized, thus allowing fusing device 48 to cool down.

As discussed above, due to the solid state physics of switching device 102 (triac 122 and/or SCRs 124, 126), gate pulse signal 104 should be of sufficient duration to properly energize switching device 102, and the minimum pulse duration of gate pulse signal 104 may vary depending on the specifics of switching device 102. As discussed above, for a Model No.: BTB24-600BWS triac manufactured by ST Microelectronics, the minimum pulse duration of gate pulse signal 104 is approximately 1.00 millisecond. Further and as discussed above, in order to regulate the amount of power provided to fusing device 48, the point within the sinusoid at which gate pulse signal 104 is applied to switching device 102 is varied, since switching device 102 may only stop conducting power signal 108 at the points (e.g., points 156, 158) at which the current flowing through switching device 102 is zero.

Accordingly and continuing with the above stated example, if (during "Use Mode") the temperature of fusing device 48 is determined to be 190° C., fusing device 48 may be energized for 2.00 millisecond to elevate the temperature of fusing device 48 from 190° C. to 200° C. (i.e., the setpoint). As switching device 102 (once energized) will continue to conduct electricity and, therefore, provide power signal 108 to fusing assembly 48 until point 156 (i.e., the point at which the current flowing through switching device 102 is zero), gate pulse signal 104 is initiated 6.33 millisecond after the beginning of half cycle 150.

Accordingly, control circuit 100 may monitor (via conductor 110) power signal 108 to determine when the sinusoid of power signal 108 crosses X-axis 162. Controller circuit 110 may include a zero-crossing detector (not shown) to make this determination. Accordingly, in the above-described embodiment, at 6.33 milliseconds after point 160 (i.e., at point 164), a 1.00 millisecond gate pulse signal 104 may be provided to switching device 102. Since switching device 102 (once energized) may continue to conduct electricity and, therefore, provide power signal 108 to fusing device 48 until point 156 (i.e., the point at which the current flowing through switching device 102 is zero), switching device 102 may provide power signal 108 to fusing device 48 for 2.00 milliseconds.

Further, if (during "Use Mode") the temperature of fusing device 48 is determined to be 198° C., control circuit 100 may determine that fusing device 48 should be energized for 0.40 milliseconds to elevate the temperature of fusing device 48 from 198° C. to 200° C. (i.e., the setpoint). Accordingly and as discussed above, this may require that at 7.93 milliseconds after point 160, a 1.00 millisecond gate pulse signal 104 is provided to switching device 102. However, 0.60 milliseconds of that 1.00 millisecond gate pulse signal 104 would occur within the second half cycle 152 of the sinusoid of power signal 108. Since switching device 102 (once energized) may continue to provide power signal 108 to fusing assembly 48 until point 158 (i.e., the point at which the current flowing through switching device 102 is zero), switching device 102 may be energized for the entire second half cycle 152 of the sinusoid of power signal 108 (in addition to the last 0.40 milliseconds of the first half cycle 150 of the sinusoid of power signal 108). Accordingly, fusing device 48 may be energized with power signal 108 for 8.73 milliseconds (i.e., 0.40 milliseconds from first half cycle 150 and 8.33 milliseconds from second half cycle 152). This, in turn, may result in an over temperature condition for fusing device 48.

Accordingly, prior to providing gate pulse signal 104 to switching device 102, control circuit 100 may compare 206 the duration of the power signal to be applied to fusing device 48 to the minimum pulse duration. If 208 the duration of the power signal to be applied to fusing device 48 is at least equal to the minimum pulse duration, gate pulse signal 104 may be provided 210 to switching device 102. Alternatively, if the duration of the power signal to be applied to fusing device 48 is less than the minimum pulse duration, gate pulse signal 104 may be discarded 212.

Continuing with the above-stated example, if the temperature of fusing device 48 is determined to be 190° C., control circuit 100 may determine that fusing device 48 should be energized for 2.00 millisecond to elevate the temperature of fusing device 48 from 190° C. to 200° C. (i.e., the setpoint). Accordingly, prior to providing gate pulse signal 104 to switching device 102, control circuit 100 may compare 206 the duration of the power signal to be applied to fusing device 48 (i.e., 2.00 milliseconds) to the minimum pulse duration (i.e., 1.00 milliseconds). As the duration of the power signal to be applied to fusing device 48 (i.e., 2.00 milliseconds) is at least equal to the minimum pulse duration (i.e., 1.00 milliseconds), gate pulse signal 104 is provided 210 to switching device 102. Accordingly, fusing device 48 will be energized by power signal 108 such that the 200° C. setpoint is achieved.

If e.g., the temperature of fusing device 48 is determined to be 198° C., control circuit 100 may determine that energizing fusing device 48 for 0.40 millisecond may elevate the temperature of fusing device 48 from 198° C. to 200° C. (i.e., the setpoint). However, as the duration of the power signal to be applied to the heating device (i.e., 0.40 milliseconds) is not at least equal to the minimum pulse duration (i.e., 1.00 milliseconds), gate pulse signal 104 may be discarded 212 and, therefore, not provided to switching device 102. Accordingly, fusing device 48 will not be energized by power signal 108. Therefore, fusing device 48 will continue to cool down until the "Δ Temperature" is great enough to require a power signal having a power duration at least equal to the minimum pulse duration. In this example (i.e., during "Use Mode"), once the temperature of fusing device 48 cools down to 194° C., a power signal having a duration of 1.20 millisecond may be required. As the duration of the power signal to be applied to the heating device (i.e., 1.20 milliseconds) is at least equal to the minimum pulse duration (i.e., 1.00 milliseconds), gate pulse signal 104 would be provided 210 to switching device 102.

While control circuit 100 is described above as being a stand-alone circuit, other configurations are possible. For example, the functionality of control circuit 100 may be implemented via one or more processes (not shown) executed by e.g., microprocessor 16. The instruction sets and subroutines of these processes (not shown) may be stored on a storage device (e.g., ROM 20) and executed by microprocessor 16 using RAM 18. Other examples of the storage device may include a hard disk drive or an optical drive, for example.

While control circuit 100 is described above as being a digital circuit, other configurations are possible. For example, controller circuit 100 may be an analog circuit. Accordingly switching device 102 may be configured to accept an analog signal provided by analog control circuit 100 or, alternatively, an analog-to-digital converter may be used to convert an analog control signal (provided by analog control circuit 100) into a digital signal that is provided to switching device 102.

While the heating device being controlled by control circuit 100 is described above as a fusing device, other configurations are possible. For example, control circuit 100 may control the temperature of a heating device used to dry ink within an inkjet printer.

A number of implementations have been described. Nevertheless, it will be understood that various modifications may be made. Accordingly, other implementations are within the scope of the following claims.

What is claimed is:

1. A circuit comprising:

a switching device for controlling a power signal to be applied to a heating device; and a control circuit configured for comparing a temperature signal, indicative of the temperature of the heating device, to a temperature setpoint to generate a gate pulse signal that controls the duration of the power signal to be applied to the heating device, wherein the control circuit is further configured for comparing the duration of the power signal to be applied to the heating device to a minimum pulse duration of the gate pulse signal and, if the duration of the power signal to be applied to the heating device is at least equal to the minimum pulse duration, providing the gate pulse signal to the switching device.

2. The circuit of claim 1 further comprising:

a temperature monitoring device for generating the temperature signal.

3. The circuit of claim 2 wherein the temperature monitoring device includes a thermistor.

4. The circuit of claim 1 wherein the control circuit is further configured for discarding the gate pulse signal if the duration of the power signal to be applied to the heating device is less than the minimum pulse duration.

5. The circuit of claim 1 wherein the switching device includes a triac.

6. The circuit of claim 1 wherein the switching device includes a silicon controlled rectifier.

7. The circuit of claim 1 wherein the power signal to be applied to the heating device is an AC power signal and the switching device is configured to provide the AC power signal to the heating device upon receiving the gate pulse signal and to continue to provide the AC power signal to the heating device until the AC power signal changes polarity.

8. An assembly comprising:

a heating device;

a switching device for controlling a power signal to be applied to the heating device; and a control circuit configured for comparing a temperature signal, indicative of the temperature of the heating device, to a temperature setpoint to generate a gate pulse signal that controls the duration of the power signal to be applied to the heating device, wherein the control circuit is further configured for comparing the duration of the power signal to be applied to the heating device to a minimum pulse duration of the gate pulse signal and, if the duration of the power signal to be applied to the heating device is at least equal to the minimum pulse duration, providing the gate pulse signal to the switching device.

9. The assembly of claim 8 further comprising:

a temperature monitoring device for generating the temperature signal.

10. The assembly of claim 8 wherein the control circuit is further configured for discarding the gate pulse signal if the duration of the power signal to be applied to the heating device is less than the minimum pulse duration.

11. The assembly of claim 8 wherein the power signal to be applied to the heating device is an AC power signal and the switching device is configured to provide the AC power signal to the heating device upon receiving the gate pulse signal and to continue to provide the AC power signal to the heating device until the AC power signal changes polarity.

12. A method comprising:

comparing a temperature signal, indicative of the temperature of a heating device, to a temperature setpoint to generate a gate pulse signal that controls the duration of a power signal to be applied to the heating device;

comparing the duration of the power signal to be applied to the heating device to a minimum pulse duration of the gate pulse signal; and providing the gate pulse signal to a switching device if the duration of the power signal to be applied to the heating device is at least equal to the minimum pulse duration, wherein the switching device is configured to control the power signal to be applied to the heating device.

13. The method of claim 12 further comprising:

generating the temperature signal using a temperature monitoring device.

14. The method of claim 13 wherein the temperature monitoring device includes a thermistor.

15. The method of claim 12 further comprising:

discarding the gate pulse signal if the duration of the power signal to be applied to the heating device is less than the minimum pulse duration.

16. The method of claim 12 wherein the switching device includes a triac.

17. The method of claim 12 wherein the switching device includes a silicon controlled rectifier.

18. The method of claim 12 wherein the power signal to be applied to the heating device is an AC power signal and the switching device is configured to provide the AC power signal to the heating device upon receiving the gate pulse signal and to continue to provide the AC power signal to the heating device until the AC power signal changes polarity.

19. A computer program product residing on a computer readable medium having a plurality of instructions stored thereon which, when executed by a processor, cause the processor to:

compare a temperature signal, indicative of the temperature of a heating device, to a temperature setpoint to generate a gate pulse signal that controls the duration of a power signal to be applied to the heating device;

compare the duration of the power signal to be applied to the heating device to a minimum pulse duration of the gate pulse signal; and provide the gate pulse signal to a switching device if the duration of the power signal to be applied to the heating device is at least equal to the minimum pulse duration, wherein the switching device is configured to control the power signal to be applied to the heating device.

20. The computer program product of claim 19 further comprising instructions for:

generating the temperature signal using a temperature monitoring device.

21. The computer program product of claim 20 wherein the temperature monitoring device includes a thermistor.

22. The computer program product of claim 19 further comprising instructions for:

discarding the gate pulse signal if the duration of the power signal to be applied to the heating device is less than the minimum pulse duration.

23. The computer program product of claim 19 wherein the switching device includes a triac.

24. The computer program product of claim 19 wherein the switching device includes a silicon controlled rectifier.

25. The computer program product of claim 19 wherein the power signal to be applied to the heating device is an AC power signal and the switching device is configured to provide the AC power signal to the heating device upon receiving the gate pulse signal and to continue to provide the AC power signal to the heating device until the AC power signal changes polarity.

* * * * *